US005757330A

United States Patent [19]

Parfitt

[11] Patent Number: 5,757,330

[45] Date of Patent: May 26, 1998

[54] ANTENNA HAVING IMPROVED DIRECTIONALITY

[75] Inventor: Graham John Parfitt, London, United Kingdom

[73] Assignee: Racal-Decca Marine Limited, Berkshire, United Kingdom

[21] Appl. No.: 557,144

[22] PCT Filed: Apr. 18, 1995

[86] PCT No.: PCT/GB95/00871

§ 371 Date: Dec. 14, 1995

§ 102(e) Date: Dec. 14, 1995

[87] PCT Pub. No.: WO95/29518

PCT Pub. Date: Nov. 2, 1995

[30] Foreign Application Priority Data

Apr. 20, 1994 [GB] United Kingdom ..... 9407845.8

[51] Int. Cl.[6] ..... H01Q 13/00

[52] U.S. Cl. ..... 343/772; 343/785; 343/786

[58] Field of Search ..... 343/771, 772, 343/776, 785, 786, 780; 333/248

[56] References Cited

U.S. PATENT DOCUMENTS

| | | | |
|---|---|---|---|
| 2,743,440 | 4/1956 | Riblet | 343/778 |
| 2,785,397 | 3/1957 | Rust et al. | 343/753 |
| 3,854,141 | 12/1974 | Smits | 343/785 |
| 4,488,157 | 12/1984 | Terakawa et al. | 343/785 |
| 4,829,312 | 5/1989 | Terakawa et al. | 343/771 |
| 4,835,543 | 5/1989 | Sequeira | 343/785 |
| 4,841,308 | 6/1989 | Terakawa | 343/785 |
| 5,461,394 | 10/1995 | Weber | 343/786 |

FOREIGN PATENT DOCUMENTS

| | | |
|---|---|---|
| 1 126 698 | 9/1968 | United Kingdom . |
| 1 133 343 | 11/1968 | United Kingdom . |
| 2 157 082 | 10/1985 | United Kingdom . |
| 2 158 650 | 11/1985 | United Kingdom . |

OTHER PUBLICATIONS

"Microwave Antennas", Dielectric Antennaa, by A.Z. Fradin, published Pergamon, 1961, pp. 566–577, no month.

"Analysis of Propagating Modes in Dielectric Sheets" by leonard Hatkin, *Proceedings of the I–R–E*, Oct. 1954, pp. 1565–1568.

*Primary Examiner*—Donald T. Hajed
*Assistant Examiner*—Tan Ho
*Attorney, Agent, or Firm*—Westman, Champlin & Kelly, P.A.

[57] ABSTRACT

An antenna for transmitting or receiving electromagnetic radiation along an axis comprises at least three layers 20*a*, 20*b*, 20*c*, 20*d* and 20*e* of dielectric material spaced from one another in a direction perpendicular to the axis. The outermost layers 20*a* and 20*e* are spaced from one another by at least half the wavelength of the electromagnetic radiation. The layers extend generally in the direction of the axis from a rear end to a front end of the layers. A transition portion 22 electromagnetically couples the layers 20*a*, 20*b*, 20*c*, 20*d* and 20*e* directly to a waveguide 21. A front end of the transition portion 22 is connected to the rear end of the layers 20*a*, 20*b*, 20*c*, 20*d* and 20*e* and has a dimension in the direction perpendicular to the axis substantially equal to the spacing between the outermost layers 20*a*, 20*e* at the rear end of the layers.

27 Claims, 14 Drawing Sheets

50
50
180°
144°
108°
72°
36°
0°
36°
72°
108°
144°
180°
0
-10
-20
-30
RELATIVE POWER (dB)
TWO PANEL ANTENNA.
ELEVATION PATTERN.

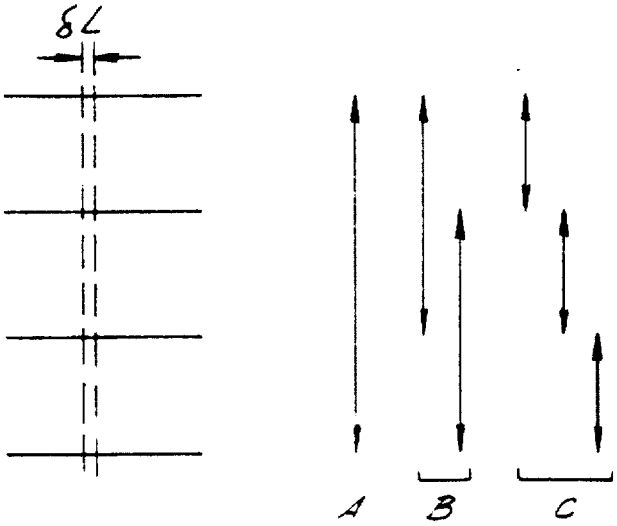
FIG. 9a.
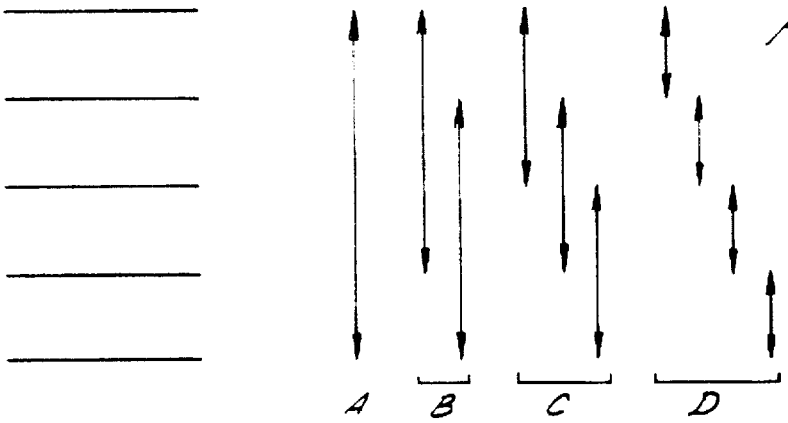
FIG. 9b.
FIG. 9c.
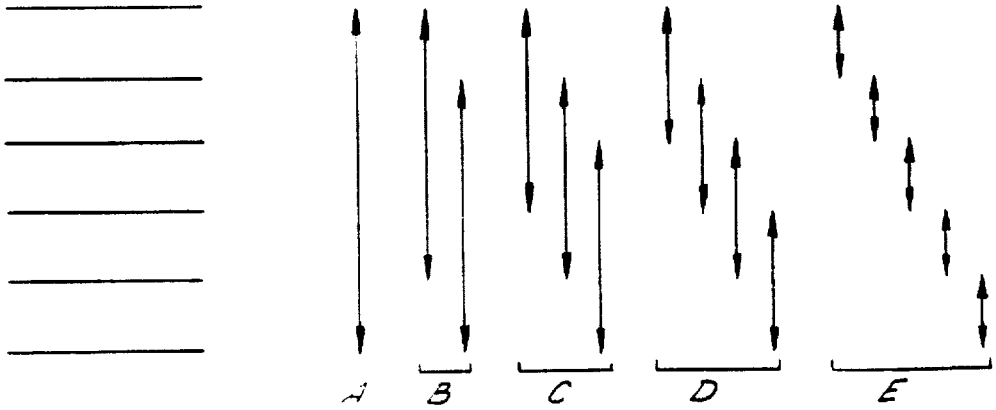

ANTENNA HAVING IMPROVED DIRECTIONALITY

BACKGROUND OF THE INVENTION

The present invention relates to an antenna for at least one of the transmission and the reception of electromagnetic radiation.

Conventional marine navigation radar antennas present a large area to wind because the radiating aperture is in the vertical plane. Such radar antennas comprise a horn arrangement as shown in FIG. 1 in cross-section. In such an arrangement a linear array antenna comprises a slotted waveguide 1 with slots 1*a* provided in a side wall coupled to a feedhorn 2. This configuration is termed "broadside fire" because the axis of the main beam is orthogonal to the plane of the aperture generally indicated by reference numeral 3.

The problem with such conventional radar antennas is that in order to provide the required beam width of the beam using such a "broadside fire" arrangement, the size of the aperture in the vertical direction is large, thus providing high wind resistance. Because of the poor aerodynamics of the structure, the antenna must be strongly fixed to a mounting which must be driven by a large and powerful motor to provide accurate rotation of the radar antenna so that its rotation is minimally effected by wind speed and direction.

It is therefore highly desirable to reduce the vertical dimensions of radar antennas. As an alternative to using the "broadside fire" configuration, the "end fire" configuration has been studied. One simple form of such an "end fire" antenna is the polythene rod or "polyrod" as shown in FIG. 2.

In the "polyrod" "end fire" configuration the radiating aperture is along the axial length of the rod and therefore directionality is increased by increasing the length of the aperture, i.e. the length of the polyethylene rod 6 in FIG. 2. The polyethylene rod 6 is coupled electromagnetically to the radiation provided from a waveguide 4 by a transition element 5. In the "polyrod" configuration the polyethylene forms a "leaky" antenna structure wherein energy "leaking" from the surface of the rod combines constructively in the direction the rod points, thus forming a beam.

The problem with using such an arrangement for a radar antenna is the weight of the polyethylene rod. To use such an arrangement would require strong fixings and a powerful drive motor, not only to cope with the weight, but also to cope with the fact that the "polyrod" would need to be quite long in order to provide the required beam width and therefore it would be susceptible to down draught and up draughts.

In order to overcome the weight disadvantage of the "polyrod" arrangement of FIG. 2, Japanese Patent No. 56-31205 has proposed the use of a hollow "polyrod" shown in FIG. 3 comprising a slotted waveguide 7 with slots 7*a* coupled to a hollow dielectric rod 9 via a transition element 8. However, whilst this arrangement overcomes the weight disadvantage of the "polyrod" arrangement this arrangement still suffers from the disadvantage of requiring a long axial length in order to provide sufficient beam width.

This problem has been further considered in Japanese Patent No. 62-171301 which discloses the arrangement disclosed in FIG. 4. In this arrangement a slotted waveguide 10 is coupled to a feedhorn 11 via a transition element 12. At the aperture of the feedhorn 11 is provided a double skin dielectric structure 13. The double skin dielectric stucture 13 is provided at the aperture of the feedhorn 11 to avoid having to increase the vertical aperture size of the feedhorn 11. However, whilst this arrangement reduces the length of the dielectric structure required to provide the necessary beam width, it still provides an arrangment which has a disadvantageous aerodynamic cross-section.

SUMMARY OF THE INVENTION

It is therefore an object of the present invention to provide an antenna which has a reduced aerodynamic cross-section together with a reduced length whilst still providing the required beam width.

In one aspect the present invention provides an antenna for at least one of the transmission and the reception of electromagnetic radiation along an axis comprising at least three layers formed of dielectric material spaced from one another in a direction perpendicular to said axis, outermost layers being spaced from one another by at least half the wavelength of said electromagnetic radiation, said layers extending generally in the direction of said axis from a rear end to a front end of said layers; and a transition portion adapted to electromagnetically couple said layers directly to a waveguide, a front end of said transition portion being connected to said rear end of said layers and having a dimension in the direction perpendicular to said axis substantially equal to the spacing between outermost layers at said rear end of said layers.

In another aspect the present invention provides an antenna for at least one of the transmission and the reception of electromagnetic radiation along an axis comprising at least five layers formed of dielectric material spaced from one another in a direction perpendicular to said axis, outermost layers being spaced from one another by at least half the wavelength of said electromagnetic radiation, said layers extending generally in the direction of said axis from a rear end to a front end of said layers; and a transition portion connected to said rear end of said layers and adapted to electromagnetically couple said layers to a waveguide.

In a further aspect the present invention provides an antenna for at least one of the transmission and the reception of electromagnetic radiation along an axis comprising at least three layers formed of dielectric material, each said layer having a mean spacing from a neighbouring layer in a direction perpendicular to said axis of substantially a quarter of the wavelength of said electromagnetic radiation, said layers extending generally in the direction of said axis from a rear end to a front end of said layers; and a transition portion connected to said rear end of said layers and adapted to electromagnetically couple said layers to a waveguide.

In the present invention the provision of the separated layers increases the directivity of the antenna by introducing multiple reflections within the beam forming structure. The effect of the multiple reflections is modified by the array factor of the antenna to produce an improved beam width for a reduced antenna length compared to the prior art "polyrod" or hollow "polyrod" and of reduced height compared to the conventional horn arrangement.

Preferably the layers are arranged symmetrically about the axis in order to provide a beam symmetrical about a beam axis.

In one embodiment the layers extend in planes and the axis lies on a central plane, the layers being spaced from one another in a direction perpendicular to the central plane. Such an arrangement provides a linear array antenna formed of panels of dielectric material which are preferably symmetrically arranged about the central plane to provide a beam pattern having symmetry in elevation.

Conveniently, in such a linear array antenna the transition portion is adapted to directly couple the layers to a slotted waveguide. Such a slotted waveguide can have slots cut in either the side wall or the broad wall of the waveguide.

In another embodiment the layers extend around the axis to form substantially concentric hollow members. Such hollow members can be of any cross sectional shape such as square, rectangular, round, oval or elliptical. The cross sectional shape of the hollow members will affect the two-dimensional beam pattern.

In an alternative embodiment at least three further layers formed of dielectric material are provided spaced from one another in a direction perpendicular to the axis and to the layers and intersecting the layers. The further layers extend generally in the direction of the axis from the rear and to the front end of the layers. Preferably the spacing between the layers and the further layers is the same so that the antenna provides a two-dimensional beam shape which is the similar in two directions.

Conveniently, the layers are substantially evenly spaced from one another and either air or a second material whose dielectric constant is low compared to the dielectric constant of the material forming the layers can be provided between the layers. Such a material can be expanded polystyrene or expanded polyurethane.

Depending on the beam width and beam pattern required the layers can be arranged in many different configurations along the axis. The layers can be arranged essentially parallel to the axis, spacing between the layers can taper from the rear end to the front end or the spacing between only the outer layers can taper from the rear end to the front end.

In another embodiment, the thickness of the layers can taper from the rear end to the front end. All or only the inner or outer layers can taper in such a manner depending on the required modification of the electric field distribution within and radiated from the dielectric structure.

Preferably, the average thickness of the layers is between 1 and 5 hundredths of the wavelength of the electromagnetic radiation and more preferably between 2 and 4 hundredths. Such a thickness of the dielectric layers provides for optimum directionality.

Conveniently, the dielectric layers could be formed of dielectric material such as polyethylene or polycarbon.

Ideally the mean spacing between the layers is substantially a quarter of the wavelength of the electromagnetic radiation since this provides for the optimum interference effect.

Preferably the ratio of the length of the outermost layers from the rear end to the front end, to the mean spacing between the outermost layers is substantially 4:1. Such a structure is the optimum area of dynamic shape and if the length is longer then the structure is weaker whilst if the structure is wider it is less aerodynamic.

BRIEF DESCRIPTION OF THE DRAWINGS

FIGS. 9*a*, 9*b* and 9*c* illustrate the range of spacings given at a fraction of the free space wavelength of the radiation between layers in a four, five and six layer antenna respectively;

DESCRIPTION OF THE PREFERRED EMBODIMENTS

Figure 1:
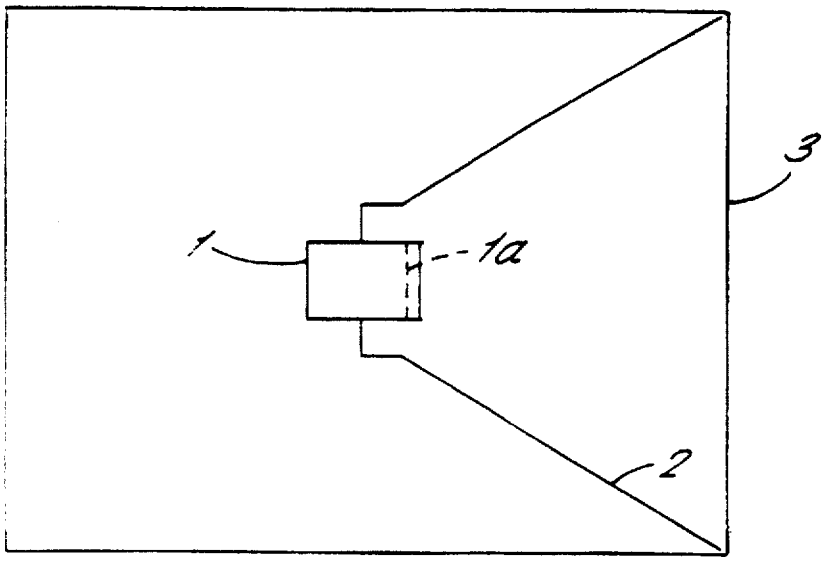
FIG. 1. PRIOR ART.
FIG. 1 is a cross-section through a prior art linear array antenna utilising a conventional "broadside fire" horn.
Figure 3:
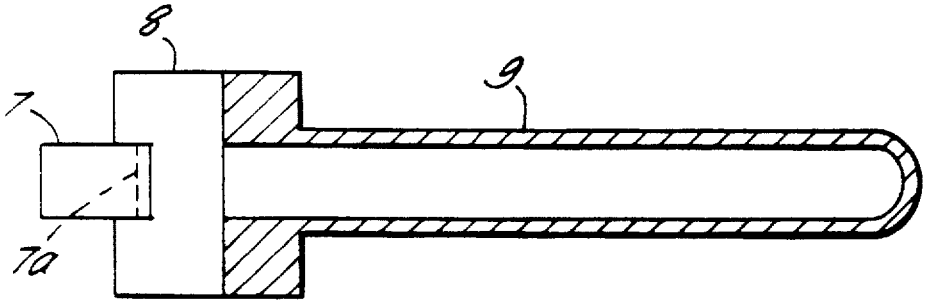
FIG. 3. PRIOR ART.
FIG. 3 is a sectional view through a prior art linear array antenna utilising a slotted waveguide and a hollow "polyrod"
Figure 2:
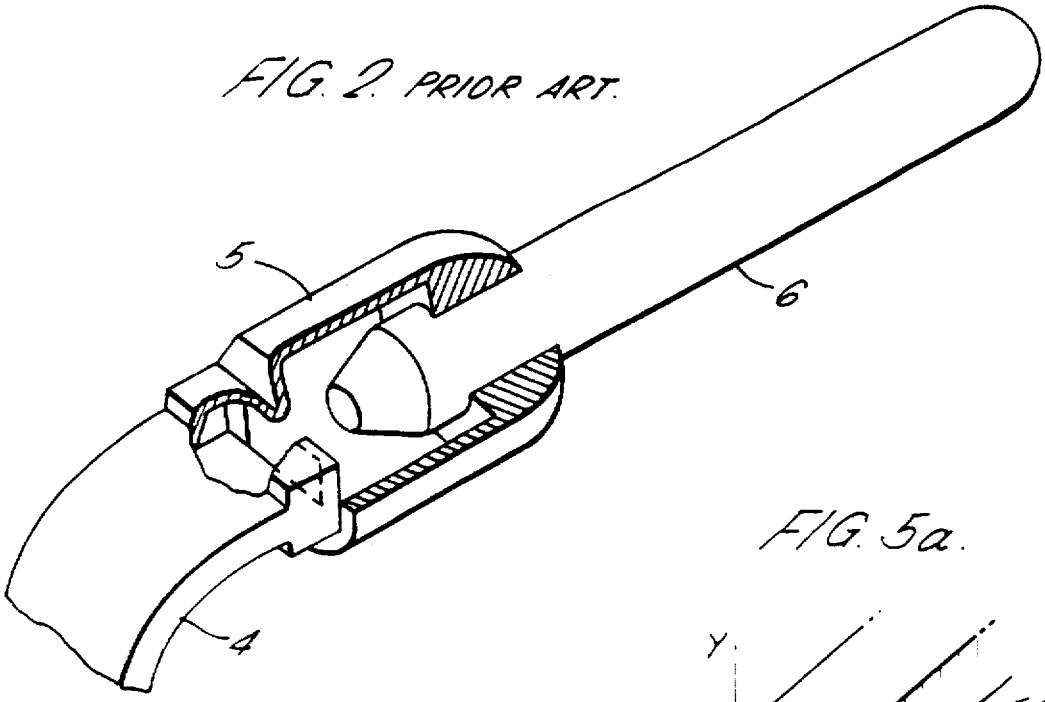
FIG. 2. PRIOR ART.
FIG. 2 is a partially cut-away of a conventional "end fire" "polyrod" antenna.
Figure 5A:
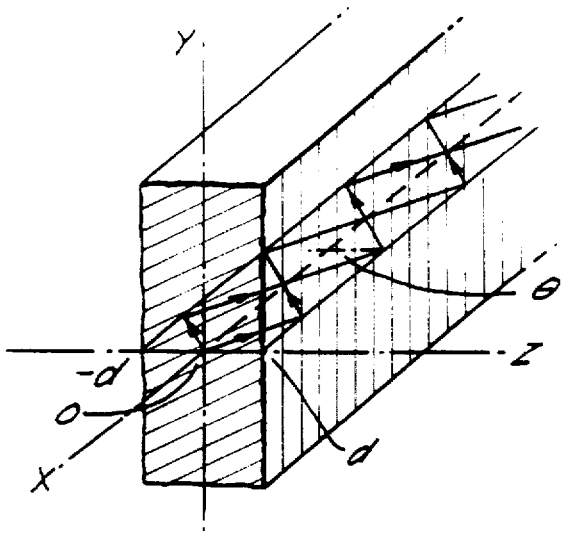
FIGS. 5*a* and 5*b* are illustrations of the propagation of electromagnetic radiation down a sheet of dielectric material.
Figure 5B:
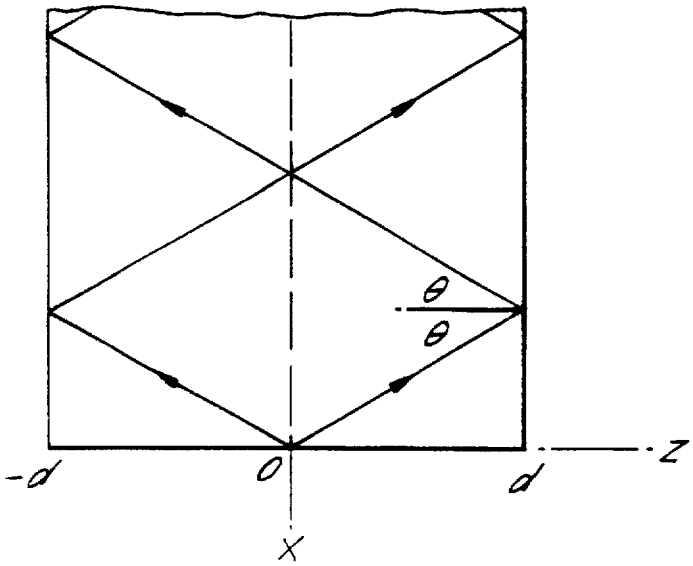
Figure 4:
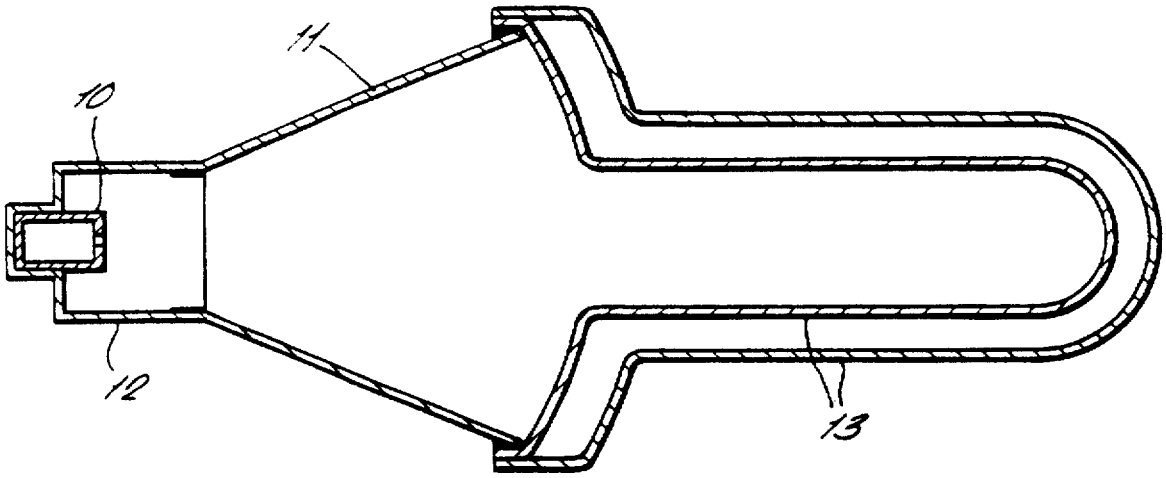
FIG. 4. PRIOR ART.
FIG. 4 is a sectional view of a prior art linear array antenna utilising a combination of a conventional horn and a double skinned dielectric structure.

Referring now to the drawings, FIGS. 5*a* and 5*b* illustrate the principles behind the present invention wherein an electromagnetic beam propagates down a dielectric material by reflection therefrom. The theory for propagating modes in sheets of dielectric material is given in an article by Leonard Hatkin, "Proceedings of the IRE", October 1954, pages 1565–1568. From this it can be seen that energy is contained within the panel by reflection from the discontinuities at the air to dielectric interfaces. Although FIGS. 5*a* and 5*b* illustrate the case for propagation of electromagnetic radiation down a dielectric panel the theory is equally applicable to propagation of electromagnetic radiation along a space between two dielectric panels. Reflections occur at discontinuities at the air to dielectric interfaces.

Figure 6:
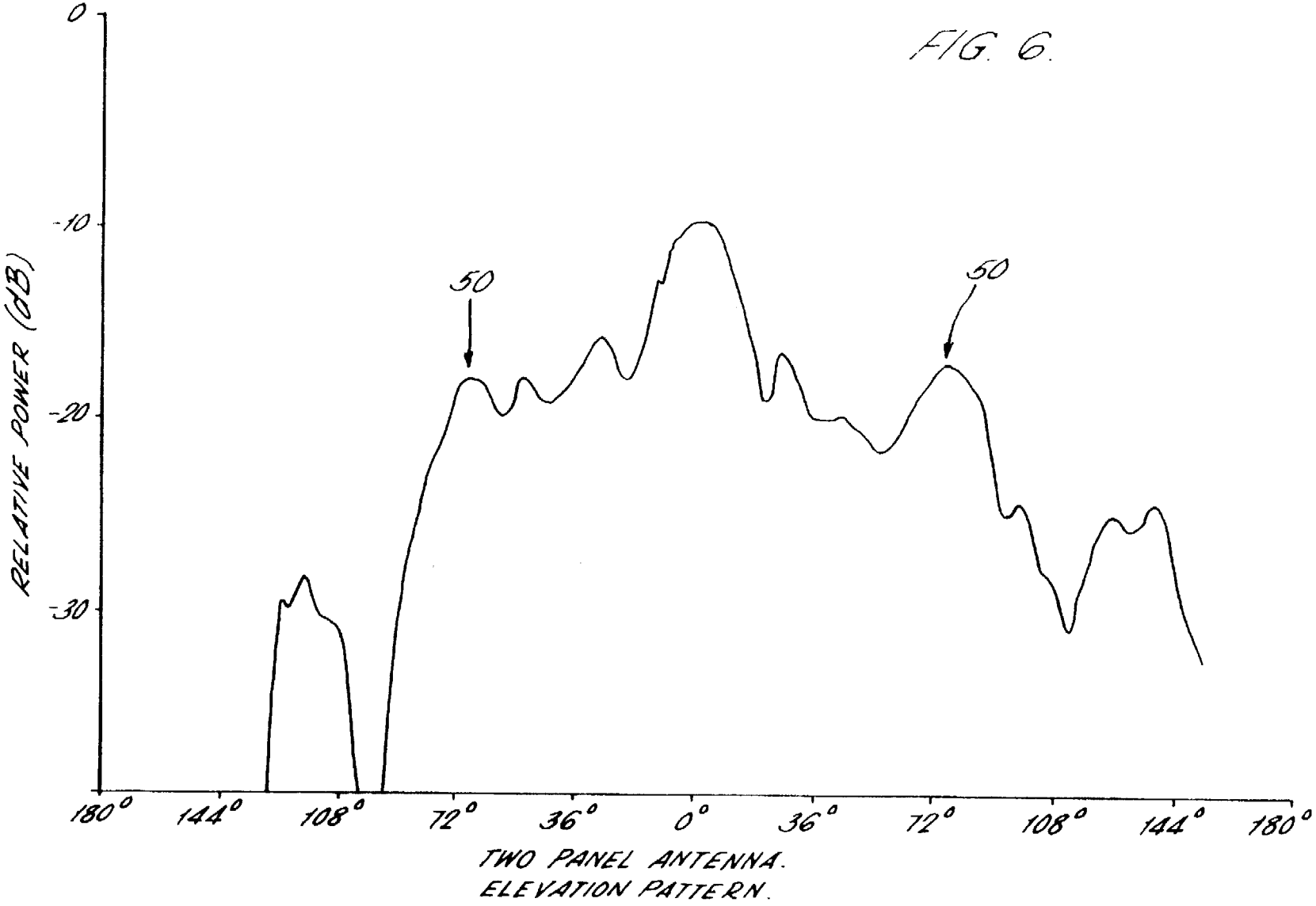
FIG. 6 illustrates the elevation beam pattern obtained from an antenna formed of two layers of dielectric material.

FIG. 6 illustrates the elevation beam pattern obtained from an antenna formed of two parallel layers of dielectric material. Two prominent side lobes or "shoulders" 50 can be seen in the pattern. These "shoulders" 50 arise from the interference between reflected beams emitted from the layers. The occurrence of these "shoulders" provide a significantly increased beam width and are therefore highly undesirable. The present invention ulitises more than two dielectric layers to reduce these "shoulders" and hence reduce the beam width.

Figure 7:
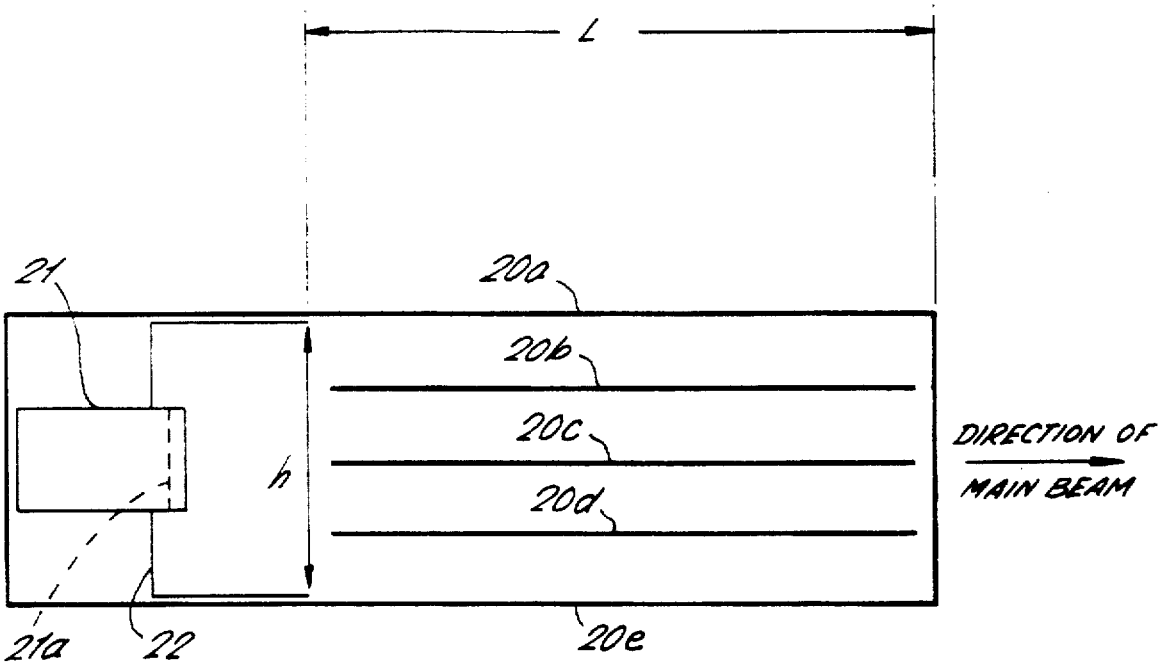
FIG. 7 illustrates a cross-section through a linear array antenna utilising five planar layers according to one embodiment of the present invention.

FIG. 7 illustrates a cross-section through a linear array antenna formed of five planar layers 20*a* through e according to one embodiment of the present invention. A slotted waveguide 21 is provided with slots 21*a* and this is coupled to the dielectric layers 20*a* through e via a transition portion 22. The transition portion has a height h substantially equal to the separation of the outermost layers 20*a* and 20*e* of dielectric material. The transition portion 22 provides efficient electromagnetic coupling between the slotted waveguide 21 and the dielectric layers 20*a* through e. Although in FIG. 6 the transition portion is shown as being rectangular in cross-section any shape that provides for efficient coupling between the slotted waveguide 21 and the planar dielectric layers 20*a* through *e* can be used. The dielectric layers 20*a* through *e* have a length from a rear end to a front end of L and are separated either by air or conveniently by a material which can support the layers which has a low dielectric constant relative the dielectric constant of the layer material. As an alternative to air as the spacing material, expanded polystyrene or expanded polyurethane for example can be used. The dielectric material used for the layers can be any suitable material such as polyethylene or polycarbon. The use of such materials provides the advantages that the design is compact, light, of simple construction and therefore relatively inexpensive to manufacture. Further, its cross-section is close to the aerodynamic ideal for the marine radar application.

Whilst FIG. 7 illustrates the use of a total of five panels, any number from three upwards can be used. There is however an optimum number of panels to be used for any particular separation of the outermost layers.

Figure 8:
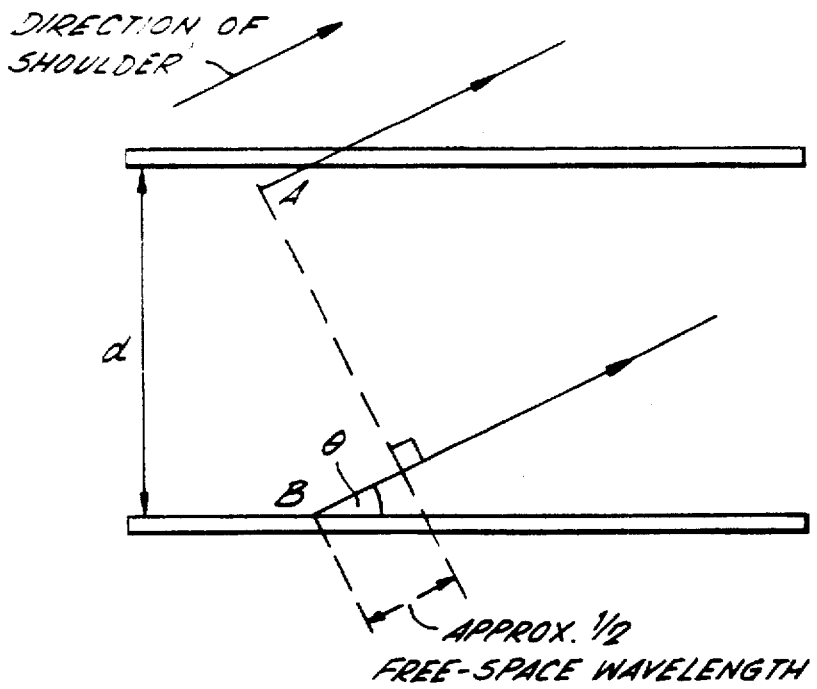
FIG. 8 illustrates the ray geometry for shoulders appearing in the beam pattern for interference between two layers.

FIG. 8 illustrates the ray geometry for the formation of "shoulders" on the beam pattern. Interference will occur when energy is reflected at B from one layer and transmitted through another layer at A. Constructive interference forming "shoulders" will occur at an angle θ when the path difference is an odd integer number of half wavelengths since there is a half wavelength phase reversal due to reflection at B. If the separation of the two panels is given by d then the angle θ at which the shoulders can be expected to occur is given by $$\theta=\sin^{-1}(\lambda/2d)$$

Since the panels extend along the axis then there can be considered to be an infinite number of infinitely small elements of length δL each contributing to the interference effect. FIGS. 9*a*, 9*b* and 9*c* illustrate the range of layer separations for a four, five and six layer antenna respectively. It can be seen from FIGS. 9*a*, 9*b* and 9*c* that unlike a hollow "polyrod" or a two layer antenna which would only have reflection components A, for a multilayer antenna energy is distributed amongst reflection components A, B, C, D and E dependent on the number of layers.

Figure 10A:
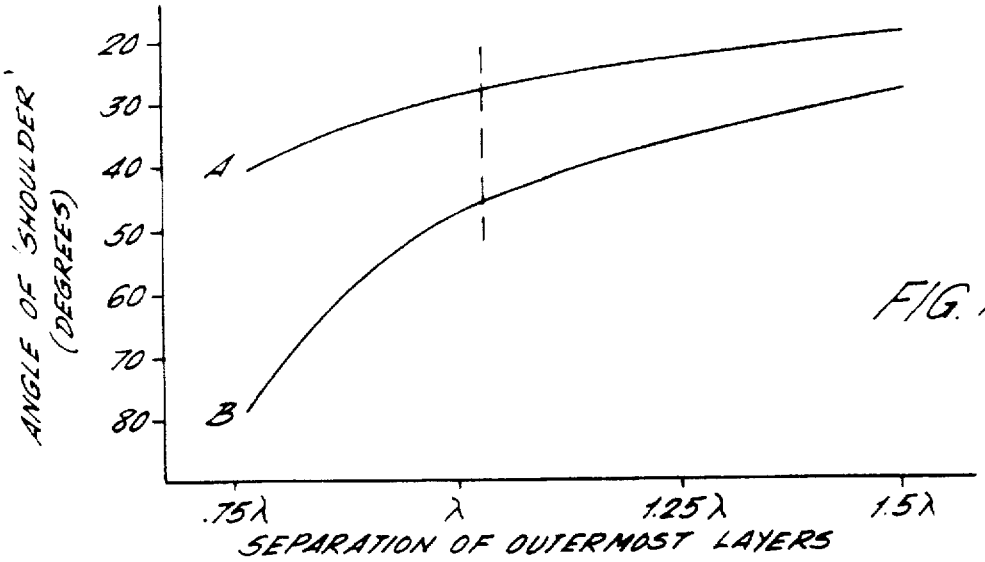
FIGS. 10*a*, 10*b* and 10*c* illustrate the theoretically calculated angle at which shoulders will appear in the beam pattern versus separation of the outmost layers given as a fraction of the free space wavelength of the radiation for the contribution from each layer separation A, B, C, D and E.
Figure 10B:
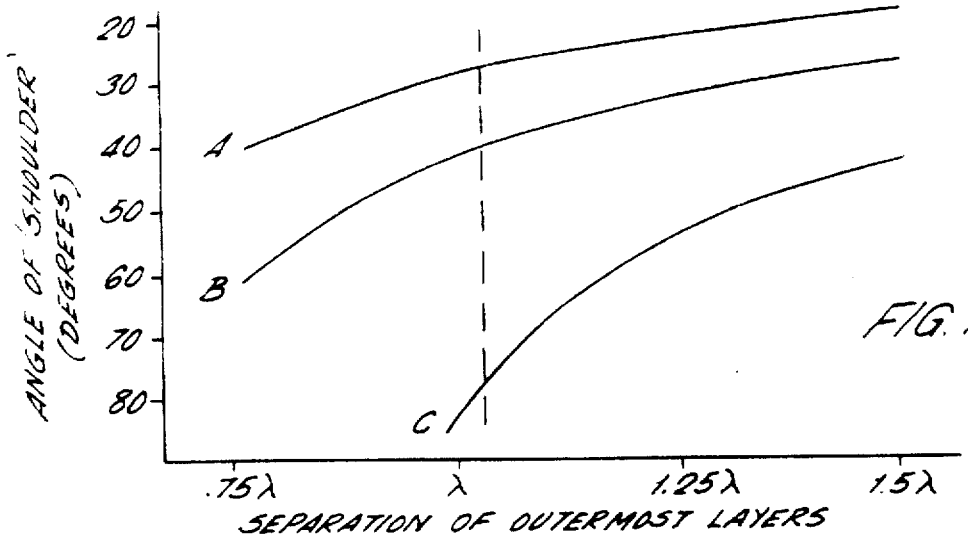
Figure 10C:
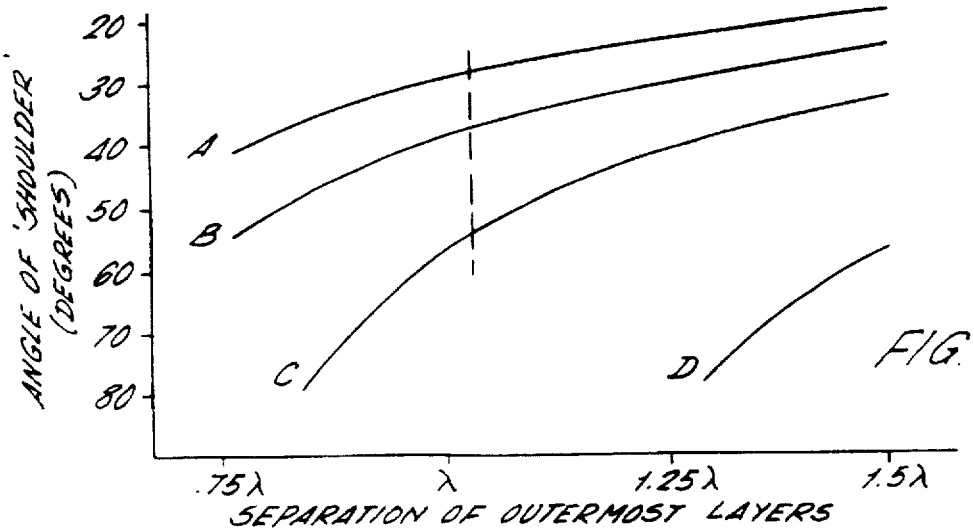

FIGS. 10*a*, 10*b* and 10*c* illustrate the calculated angle for shoulders appearing in the beam pattern versus separation of the outermost layers for a four, five and six layer antenna respectively where the layers are evenly spaced as shown in FIGS. 9*a*, 9*b* and 9*c*.

FIG. 10*a* illustrates the calculated angle of the interference components A and B. There is no curve shown for C since for even the greatest separation of the outermost layers shown of 1.42λ, the separation between the closest layers is only 0.48λ which is below half the wavelength of the electromagnetic radiation, which is below that required for interference.

Similarly, in FIG. 10*b* only the interference components A, B and C are shown since no interference will occur between the closest layers for the separation of outermost layers shown in the graphs.

Similarly, for FIG. 10*c* there will be no interference between the adjacent layers and thus only curves A, B, C and D appear.

In order to reduce the size of the shoulders produced by interference between the outermost layers, i.e. A, it is desirable to increase the number of layers which can contribute to interference, i.e. if for aerodynamic reasons the separation of outermost layers cannot be more than about 1λ then the ideal configuration is the five layer configuration of FIG. 9*b*. It can be seen from FIG. 10*a* that for separation of outermost layers of 1.02λ for a four layer arrangement shoulders will occur at 29° and 47°. For an arrangement having a similar separation of outermost layers but having five layers shoulders will occur at 29°, 41° and 79°. For an arrangement of similar separation of outermost layers but having six layers shoulders will occur at 29°, 38° and 55°. Clearly for the five and six layer arrangement the extra shoulder will help to reduce the size of the shoulder at 29°. However, in the six layer arrangement the shoulders caused by interference components B and C are closer to the axis. What is desired is the spreading of the shoulder component A away from the axis by interference components B and C and thus for a 1.02λ separation of outermost layers the optimum configuration is a five layer structure with a separation of 0.254λ between each layer.

What can be seen from FIGS. 10*a*, 10*b* and 10*c* is that ideally to get the optimum spread, each layer should be separated by substantially a quarter of the wavelength of the electromagnetic radiation. Thus for the four layer structure shown in FIG. 9*a*, as can be seen from FIG. 10*a*, the separation of outermost layers should only be 0.76λ, and for the six layer structure shown in FIG. 9*c*, as can be seen from FIG. 10*c*, the ideal separation of outermost layers should be 1.27λ

So far in discussing FIGS. 9*a*, 9*b* and 9*c* and FIGS. 10*a*, 10*b* and 10*c*, the theoretical results have only taken into consideration a single infinitesimally small element δL. However, the antenna has a length L and thus comprises a linear array comprising an infinite number of the elements δL. Thus the beam pattern produced by the antenna will be a combination of the element pattern as modified by the array factor. The array factor will have the effect of reducing the size of the interference components or shoulders occurring at large angles off-axis. Thus the combined effect of the elemental interference pattern and the array factor significantly reduces the shoulders whilst providing good antenna directionality.

Figure 11:
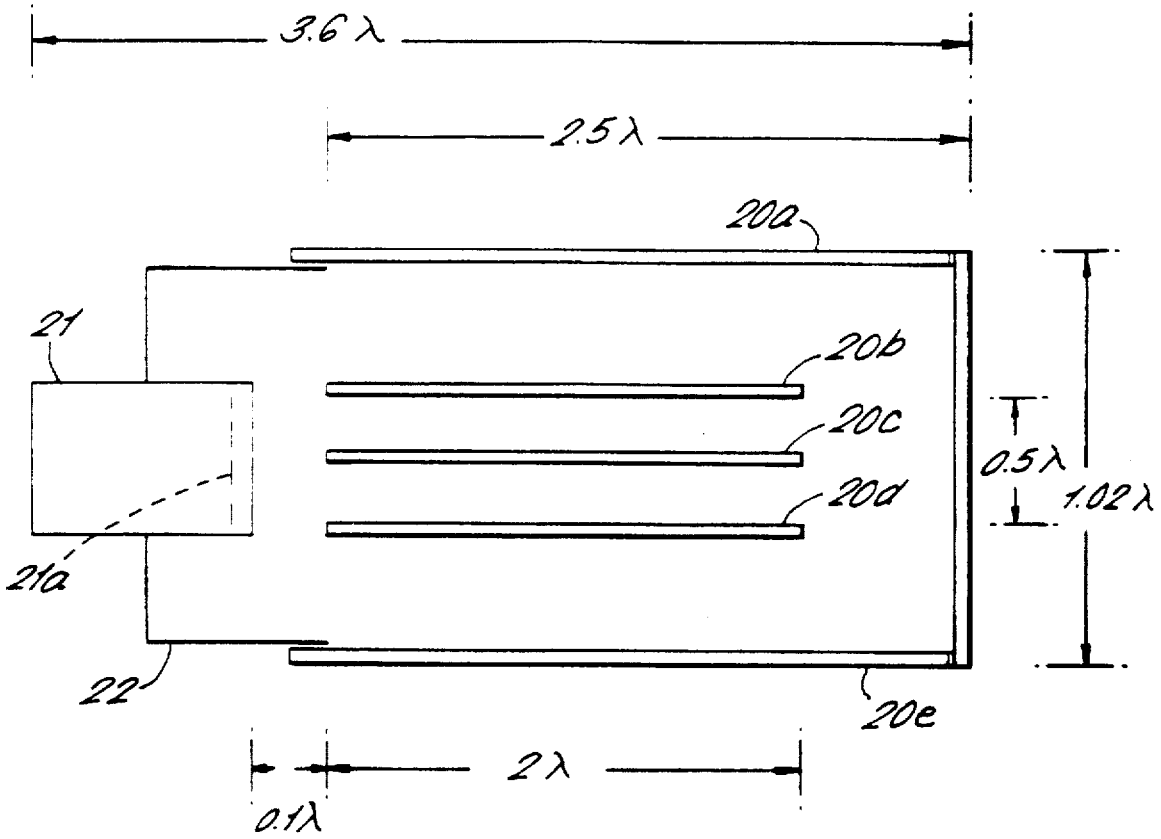
FIG. 11 illustrates a practical linear array antenna formed of five parallel planar layers of dielectric material according to one embodiment of the present invention.

Referring now to FIG. 11, this diagram illustrates a cross-section through a prototype antenna formed of five planar layers. FIG. 11 shows a similar construction to that shown in FIG. 7 and thus like reference numerals are used throughout. The outer planar panels 20*a* and 20*e* have dimensions of 2.5λ by approximately 10λ.

Figure 12:
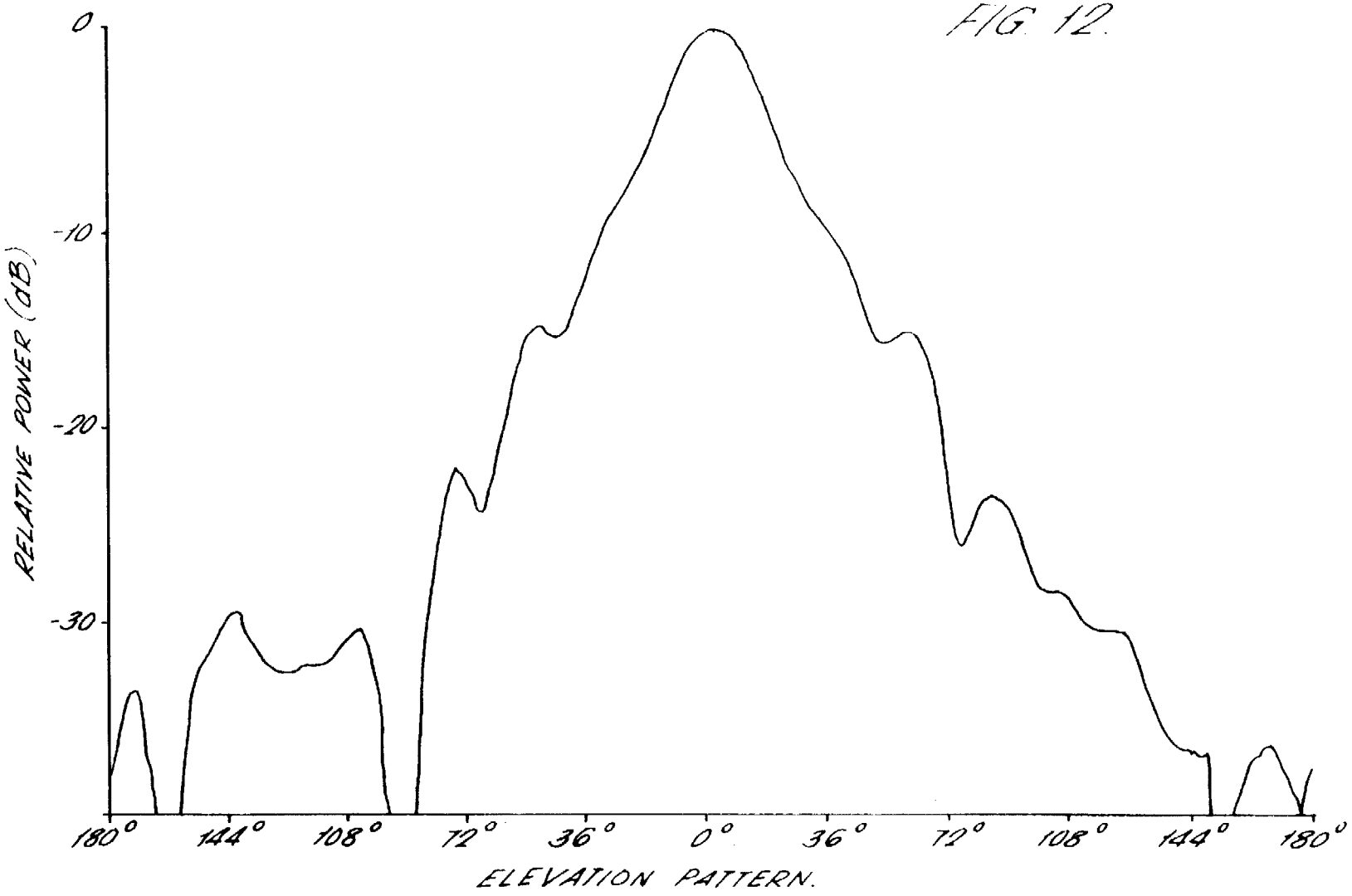
FIG. 12 illustrates the elevation beam pattern produced by the antenna of FIG. 11.

FIG. 12 illustrates the elevation beam pattern obtained using the antenna in FIG. 11. In the pattern three shoulders corresponding to interferences A, B and C can clearly be seen.

In the arrangement shown in FIG. 11, the thickness of the layers was 0.02λ and this provides a beam width of 28°. A layer thickness of 0.03λ has also been tried and provides a beam width of 24°.

Thus increasing the thickness of the dielectric layers improves the beam width. However, there is an optimum dielectric thickness and this should be at least between 1 and 5 hundredths of the wavelength of the electromagnetic radiation.

So far the only arrangement of layers discussed is three, four or five layers arranged substantially parallel to the axis of the antenna. However, as shown in FIGS. 13*a* through *d*, many different configurations can be used depending on the beam pattern required.

Figure 13A:
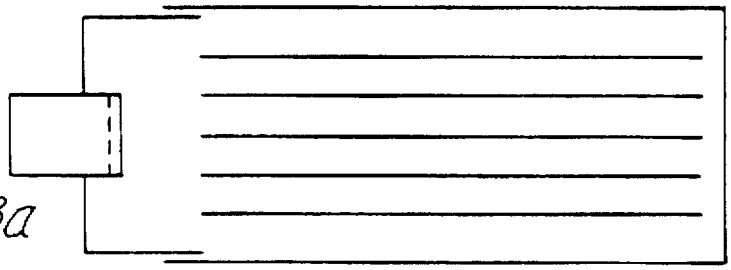
FIG. 13*a*, 13*b*, 13*c* and 13*d* illustrate alternative linear array antennas according to embodiments of the present invention.

FIG. 13*a* illustrates a seven layer arrangement wherein the layers are all arranged in parallel.

Figure 13B:
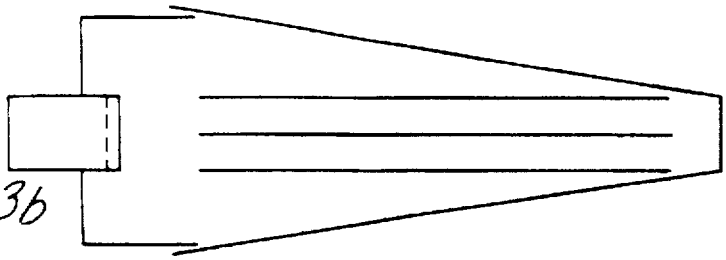

FIG. 13*b* illustrates a five layer arrangement wherein the outermost layers taper at a constant rate from the rear end to the front end of the antenna.

Figure 13C:
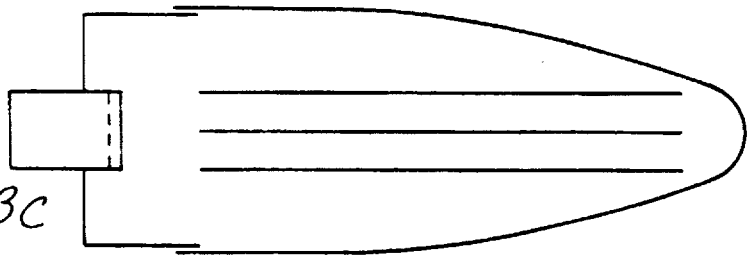

FIG. 13*c* illustrates a five layer arrangement wherein the outermost layers taper from the rear end to the front end of the antenna at an increasing rate.

Figure 13D:
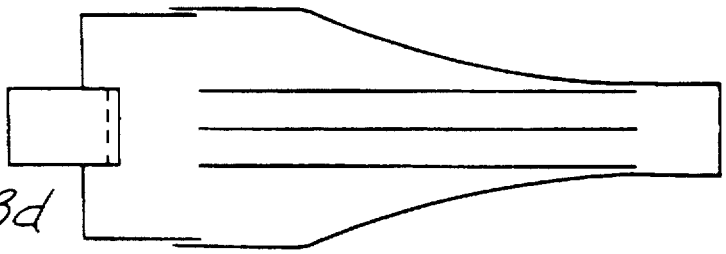

FIG. 13*d* illustrates a five layer arrangement wherein the outermost layers taper from a rear end to a front end of the antenna at a deceasing rate.

Figure 14A:
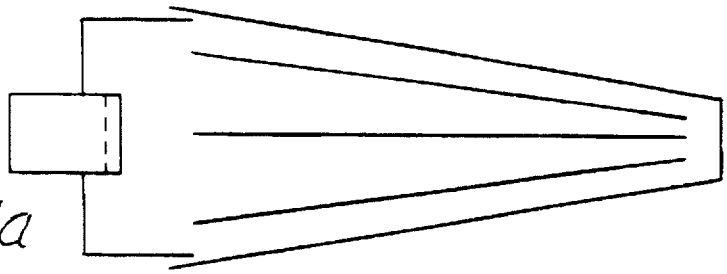
FIGS. 14*a*, 14*b*, 14*c* and 14*d* illustrate further alternative array antennas according to embodiments of the present invention.

FIGS. 14*a* through *d* illustrate further embodiments of the present invention. FIG. 14*a* illustrates a five layer arrangement wherein the spacings between all of these layers tapers from the rear end to a front end of the antenna.

Figure 14B:
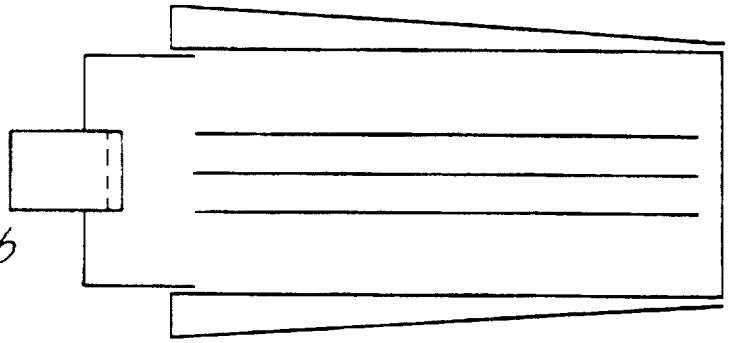

FIG. 14*b* illustrates a five layer arrangement wherein all of the layers are arranged parallel to the axis but the thickness of the outermost layers tapers from a rear end to a front end of the antenna. This modifies the electric field distribution within and radiating from the dielectric structure.

Figure 14C:
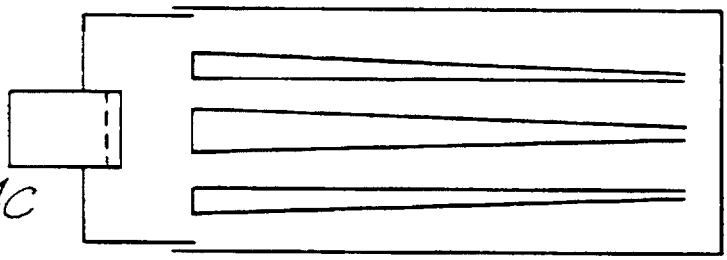

FIG. 14*c* illustrates an inverse arrangement to FIG. 14*b* wherein the structure comprises five parallel layers wherein the three inner layers have a thickness which tapers from the rear end to the front end of the antenna.

Figure 14D:
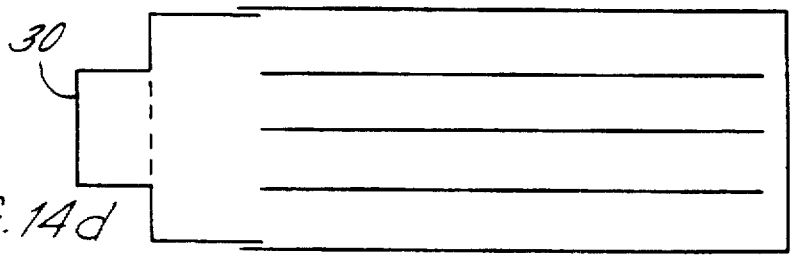

FIG. 14*d* illustrates a five layer antenna wherein the layers are arranged in parallel. In this arrangement the slotted waveguide 30 comprises a broad wall radiating waveguide. This is advantageous since this improves the polarisation purity compared with that provided by slots in the narrow wall of the waveguide.

In the embodiments described hereinabove so far, the layers have all been described as planar and thus the beam pattern is only shaped in the vertical plane by the configuration of the dielectric layers. The beam in the horizontal plane is formed by the amplitude distribution from the linear array of waveguide slots. However, the present invention is not restricted to the use of planar layers and layers can be used which simultaneously form the beam pattern in the vertical and horizontal planes.

Figure 15:
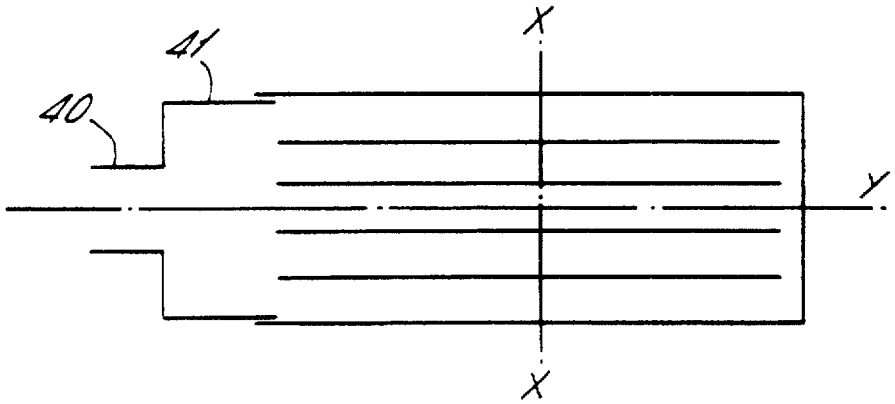
FIG. 15 is a longitudinal section through a six layer "end fire" antenna for producing a two-dimensional beam pattern according to one embodiment of the present invention.

FIG. 15 illustrates a longitudinal section through a six layer antenna which is coupled to a waveguide 40 by a transition portion 41. FIGS. 16*a*, 16*b*, 17*a* and 17*b* illustrate different possible cross-sections through X—X of FIG. 15 depending on the beam pattern required in the vertical and horizontal planes. As can be seen in these drawings the six layers appearing in cross-section actually form three concentric hollow members.

Figure 16A:
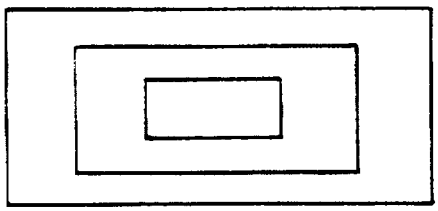
FIG. 16*a* illustrates a cross-section X—X through FIG. 15 for providing a beam pattern having different elevation and azimuth patterns.

In FIG. 16*a* the beam pattern in a vertical axis is different from that in the horizontal axis, i.e. the elevation and azimuth beam patterns are different.

Figure 16B:
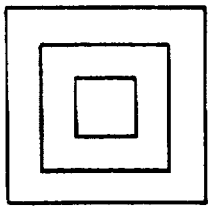
FIG. 16*b* illustrates a section X—X through FIG. 15 for an antenna having a two-dimensional beam pattern which is equal in azimuth and elevation.

In FIG. 16*b* since the separation of the layers is the same in both the horizontal and vertical directions the elevation and azimuth beam patterns would be the same.

Figure 17A:
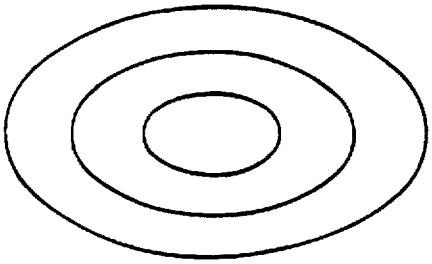
FIG. 17*a* illustrates a section X—X through FIG. 15 for an antenna capable of providing a two-dimensional beam pattern which varies continuously for rotation about the axis X between elevation and azimuth.
Figure 17B:
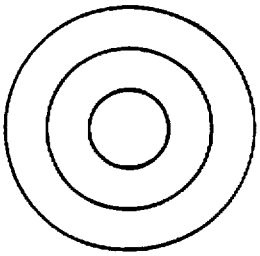
FIG. 17*b* illustrates a section X—X through FIG. 15 for an antenna for providing a beam pattern which is constant for rotation about the axis Y from elevation to azimuth and FIG. 18*a* illustrates a cross-section of an antenna for providing a beam pattern having different elevation and azimuth patterns.
Figure 18A:
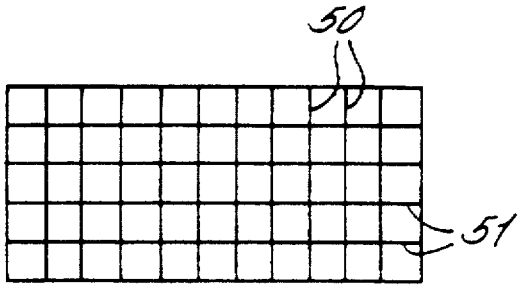
Figure 18B:
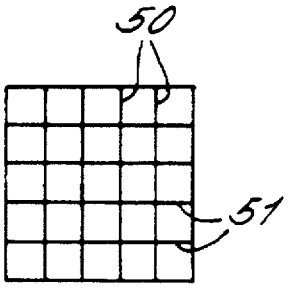
FIG. 18*b* illustrates a cross-section of an antenna for providing a two-dimensional beam pattern equal in azimuth and elevation.
Figure 19A:
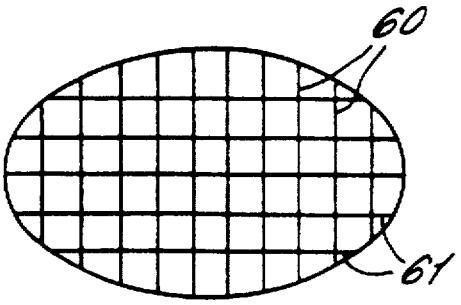
FIG. 19*a* illustrates a cross-section of an antenna for providing a two-dimensional beam pattern which varies continuously for rotation about the axis between elevation and azimuth.
Figure 19B:
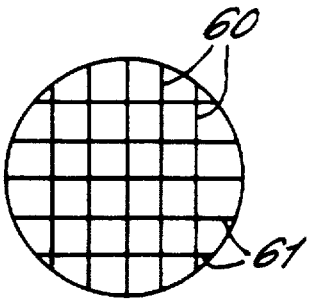
FIG. 19*b* illustrates a cross-section of an antenna for providing a beam pattern which is constant for rotation about the axis from elevation to azimuth.

FIG. 17*a* illustrates an arrangement which will provide for a beam pattern which will vary continuously from the vertical axis to the horizontal axis whilst FIG. 17*b* illustrates an arrangement which will provide for a beam pattern which has symmetry about the axis Y.

The arrangement shown in FIGS. 15 to 17 provides a two-dimensional beam pattern which depends on the cross-sectional shape of the layers which form concentric hollow members about the axis Y.

FIGS. 18*a*, 18*b*, 19*a* and 19*b* illustrate cross-sections of further arrangements for forming a two-dimensional beam pattern. In these arrangements a plurality of parallel dielectric sheets 51 and 61 are provided to form a beam in the vertical direction as described hereinabove with reference to FIGS. 7 to 14. Further, a plurality of perpendicular dielectric sheets 50 and 60 are provided which intersect the sheets 51 and 61, and which form a beam in the horizontal direction in a similar manner. Although in the figures the sheets 50, 51, 60 and 61 are shown to be equally spaced to form an equal beam shape in the two directions, the sheets 50 and 60 could be differently spaced to sheets 51 and 61 if differing beam patterns in the two directions is desired.

In FIGS. 18*a*, 18*b*, 19*a* and 19*b* the optimum inner panel separation can be maintained whilst providing virtually any antenna aperture aspect ratio.

The present invention provides many advantages. By utilising spaced layers which can either be arranged as planes or extend around an axis to form substantially concentric hollow members, a lightweight antenna of simple and less expensive construction is provided which provides the desired beam width but with reduced cross-sectional dimensions and thus an advantageous aerodynamic shape. The elimination of the flared feedhorn is an advantage since this provides a "cleaner" aerodynamic shape and attractive appearance. Further, by utilising the multiple layers the length of the projection of the dielectric laminate structure is not excessive and thus in the planar configuration the area presented to up draught in strong wind conditions is reduced. The construction can thus ideally be made to have a length to height ratio of 4:1 which is aerodynamically and mechanically preferred. Also, strong attachment of the dielectric is not required since support is provided by the rigidity of the antenna body.

What is claimed is:

1. An antenna for at least one of the transmission and the reception of electromagnetic radiation along an axis comprising at least three layers formed of dielectric material spaced from one another in a direction perpendicular to said axis, outermost layers being spaced from one another by at least half the wavelength (λ) of said electromagnetic radiation, said layers extending generally in the direction of said axis from a rear end to a front end of said layers; a waveguide, and a transition portion adapted to electromagnetically couple said layers directly to said waveguide; said transition portion having a front end defining a final transverse aperture which is connected to said rear end of said layers, said aperture having a dimension in the direction perpendicular to said axis substantially equal to the spacing between outermost layers at said rear end of said layers, said dimension and said spacing being not greater than about 1.5λ.

2. An antenna for at least one of the transmission and the reception of electromagnetic radiation along an axis comprising at least five layers formed of dielectric material spaced from one another in a direction perpendicular to said axis, outermost layers being spaced from one another by at least half the wavelength (λ) of said electromagnetic radiation, said layers extending generally in the direction of said axis from a rear end to a front end of said layers; and a transition portion connected to said rear end of said layers and adapted to electromagnetically couple said layers to a waveguide.

3. An antenna for at least one of the transmission and the reception of electromagnetic radiation along an axis comprising at least three layers formed of dielectric material, each said layer having a mean spacing from a neighboring layer in a direction perpendicular to said axis of substantially a quarter of the wavelength (λ) of said electromagnetic radiation, said layers extending generally in the direction of said axis from a rear end to a front end of said layers; and a transition portion connected to said rear end of said layers and adapted to electromagnetically couple said layers to a waveguide.

4. An antenna as claimed in claim 1 or claim 3 comprising five or more said layers.

5. An antenna as claimed in claim 2 or claim 3 wherein a front end of said transition portion is connected to said rear end of said layers and has a dimension in a direction perpendicular to said axis substantially equal to the spacing between outermost layers at said rear end of said layers.

6. An antenna as claimed in any one of claims 1, 2 or 3 wherein said layers are arranged substantially symmetrically about said axis.

7. An antenna as claimed in any one of claims 1, 2 or 3 wherein said layers extend in planes and said axis lies on a central plane, said layers being spaced from one another in a direction perpendicular to said central plane.

8. An antenna as claimed in claim 7 wherein said layers are arranged in mirror symmetry about said central plane.

9. An antenna as claimed in any one of claims 1, 2 or 3 wherein said waveguide is a slotted waveguide and said transition portion is adapted to directly couple said layers to said slotted waveguide.

10. An antenna as claimed in any one of claims 1, 2 or 3 wherein said layers extend around said axis to form substantially concentric hollow members.

11. An antenna as claimed in any one of claims 1, 2 or 3 including at least three further layers formed of dielectric material spaced from one another in a direction perpendicular to said axis and parallel to said first mentioned layers, and intersecting said first mentioned layers, said further layers extending generally in the direction of said axis from said rear end of said first mentioned layers to said front end of said first mentioned layers.

12. An antenna as claimed in any of claims 1, 2 or 3 wherein said layers are substantially evenly spaced from one another.

13. An antenna as claimed in any one of claims 1, 2 or 3 wherein air is provided between said layers.

14. An antenna as claimed in any one of claims 1, 2 or 3 including a second material provided between said layers, said second material having a low dielectric constant compared with the dielectric constant of the material forming said layers.

15. An antenna as claimed in claim 14 wherein said second material comprises expanded polystyrene.

16. An antenna as claimed in claim 14 wherein said second material comprises expanded polyurethane.

17. An antenna as claimed in any one of claims 1, 2 or 3 wherein said layers are arranged substantially parallel to said axis.

18. An antenna as claimed in any one of claims 1, 2 or 3 wherein the spacing between said layers tapers from said rear end to said front end.

19. An antenna as claimed in any one of claims 1, 2 or 3 wherein spacing between said outermost layers tapers from said rear end to said front end.

20. An antenna as claimed in any one of claims 1, 2 or 3 wherein the thickness of said outermost layers tapers from said rear end to said front end.

21. An antenna as claimed in any one of claims 1, 2 or 3 wherein the thickness of at least one of said layers between said outermost layers tapers from said rear end to said front end.

22. An antenna as claimed in any one of claims 1, 2 or 3 wherein said layers have a mean thickness of between 1 and 5 hundredths of the wavelength of said electromagnetic radiation.

23. An antenna as claimed in claim 22 wherein said layers have a mean thickness of between 2 and 4 hundredths of the wavelength of said electromagnetic radiation.

24. An antenna as claimed in any one of claims 1, 2 or 3 wherein said layers are formed of polyethylene.

25. An antenna as claimed in any one of claims 1, 2 or 3 wherein said layers are formed of polycarbon.

26. An antenna as claimed in any one of claims 1, 2 or 3 wherein the outermost layers have a mean spacing and the ratio of the length of the antenna in the direction of the axis to said mean spacing between the outermost layers is substantially 4:1.

27. An antenna as claimed in any one of claims 1, 2 or 3 wherein the layers have a mean spacing which is substantially a quarter of the wavelength of said electromagnetic radiation.

* * * * *